US008491094B2

(12) United States Patent
Kamijo et al.

(10) Patent No.: US 8,491,094 B2
(45) Date of Patent: Jul. 23, 2013

(54) FLUID EJECTION DEVICE AND METHOD OF MANUFACTURING A FLUID EJECTION DEVICE

(75) Inventors: Kimitaka Kamijo, Nagano-ken (JP); Toru Miyamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/418,874

(22) Filed: Mar. 13, 2012

(65) Prior Publication Data

US 2012/0242745 A1 Sep. 27, 2012

(30) Foreign Application Priority Data

Mar. 24, 2011 (JP) ..... 2011-066738
Mar. 28, 2011 (JP) ..... 2011-069530

(51) Int. Cl.
*B41J 2/155* (2006.01)

(52) U.S. Cl.
USPC ..... 347/43

(58) Field of Classification Search
USPC ..... 347/40, 43, 41, 105
See application file for complete search history.

(56) References Cited

U.S. PATENT DOCUMENTS

| | | | | |
|---|---|---|---|---|
| 6,960,037 | B2 | 11/2005 | Kojima et al. | |
| 7,500,729 | B2 * | 3/2009 | Sakaida | 347/14 |
| 8,366,262 | B2 * | 2/2013 | Miyamoto et al. | 347/104 |

FOREIGN PATENT DOCUMENTS

| | | | |
|---|---|---|---|
| JP | 11-034360 | A | 2/1999 |
| JP | 2004-098550 | A | 4/2004 |
| JP | 2004-130795 | A | 4/2004 |
| JP | 2007-320278 | A | 12/2007 |
| JP | 2008-074065 | A | 4/2008 |
| JP | 2008-168497 | A | 7/2008 |
| JP | 2010-012625 | A | 1/2010 |

* cited by examiner

*Primary Examiner* — Lamson Nguyen

(57) ABSTRACT

A loss of print quality is suppressed even when the recording medium is skewed by the paper feed roller. A distance D2, which is the length of separation between a black nozzle line BT of an upstream head unit and a yellow nozzle line YT of a downstream head unit, is a distance corresponding to the distance offset the conveyance distance of the recording medium when the paper feed roller turns a half revolution from the conveyance distance of the recording medium when the paper feed roller turns an integer number of revolutions.

15 Claims, 9 Drawing Sheets

| | K(BLACK) | C(CYAN) | M(MAGENTA) | Y(YELLOW) |
|---|---|---|---|---|
| OPTICAL DENSITY (OD) (VISIBLE) | 1.56 | 1.12 | 0.61 | 0.17 |

FIG. 9

FLUID EJECTION DEVICE AND METHOD OF MANUFACTURING A FLUID EJECTION DEVICE

CROSS-REFERENCE TO RELATED APPLICATIONS

The present application claims the priority of Japan Patent Application No. 2011-066738, filed on Mar. 24, 2011, and Japan Patent Application No. 2011-069530 filed on Mar. 28, 2011, all contents of which are herein incorporated by reference.

BACKGROUND

1. Technical Field

The present invention relates to a fluid ejection device that ejects fluid and forms dots on a medium, and to a method of manufacturing the fluid ejection device.

2. Related Art

Fluid ejection devices (inkjet recording device) that eject ink and form dots on a recording medium while conveying the recording medium with paper feed rollers are known from the literature. See, for example, Japanese Unexamined Patent Appl. Pub. JP-A-2010-12625. The fluid ejection device taught in JP-A-2010-12625 has a plurality of nozzle lines formed in one recording head with the nozzle lines extending in a nozzle line direction perpendicular to the conveyance direction of the recording medium. Nozzle lines with a specific relationship therebetween overlap in the recording medium conveyance direction in a specific range in the nozzle line direction. Ink is ejected from the nozzles in this overlapping area and dots are formed.

When one dot is formed in the area where one nozzle line and another nozzle line overlap, the dot is normally formed by one nozzle in one nozzle line and another nozzle corresponding to the one nozzle in the other nozzle line both ejecting ink to the position on the recording medium where the one dot is formed. However, when the recording medium is conveyed by paper feed rollers as in the above fluid ejection device, eccentricity in the paper feed roller can cause the recording medium to become skewed when conveyed, producing an offset between the position to which ink is ejected by the one nozzle and the position to which ink is ejected by the other nozzle to form one dot, and possibly resulting in a drop in print quality.

SUMMARY

The invention solves this problem and suppresses a drop in print quality even when the recording medium is skewed by the paper feed roller.

The invention can be achieved as described below and by variations thereof.

One aspect of the invention is a fluid ejection device that ejects ink from nozzles forming a nozzle line extending in a nozzle line direction perpendicular to a conveyance direction while conveying a recording medium by a paper feed roller in the conveyance direction, forming dots on the recording medium, the fluid ejection device including: a first recording head unit having nozzle lines disposed with a gap therebetween in the conveyance direction, and a second recording head unit that has nozzle lines configured in the same way as the nozzle lines of the first recording head unit and is disposed separated from the first recording head unit in the conveyance direction, the first recording head unit and second recording head unit disposed overlapping in a specific range in the nozzle line direction, and the separation distance between a first nozzle line in the first recording head unit and a second nozzle line disposed to the second recording head unit at a position corresponding to the first nozzle line being a distance corresponding to the distance offset the conveyance distance of the recording medium in a half revolution of the paper feed roller from the conveyance distance of the recording medium in an integer number of revolutions of the paper feed roller.

When the recording medium becomes skewed due to eccentricity or skewing of the paper feed roller, the period of one revolution of the paper feed roller matches the period of recording medium skew. Because print quality can drop significantly when ink dropout occurs, a drop in print quality can be effectively suppressed by suppressing the occurrence of ink dropout.

This aspect of the invention therefore creates an offset corresponding to a half revolution of the paper feed roller, that is, the greatest offset expected as an offset caused by the paper feed roller, between the position on the recording medium to which the first recording head unit ejects ink and the position on the recording medium to which the second recording head unit ejects ink when the recording medium becomes skewed due to the paper feed roller. As a result, the second recording head unit can eject ink where ink dropout from the first recording head unit occurs, and the first recording head unit can eject ink to where ink dropout from the second recording head unit occurs, color dropout can therefore be effectively suppressed and a drop in print quality can be suppressed.

In a fluid ejection device according to another aspect of the invention, the separation distance is a distance corresponding to the outside circumference of the paper feed roller multiplied by $(n-\frac{1}{2})$ (where n is a positive integer).

With this aspect of the invention the separation distance between a first nozzle line of the first recording head unit and a second nozzle line of the second recording head unit can be set using the objective value of the circumference of the paper feed roller to a distance corresponding to the conveyance distance of the recording medium when the paper feed roller turns a half revolution from the conveyance distance of the medium when the paper feed roller turns an integer number of revolutions.

Another aspect of the invention is a fluid ejection device that ejects ink from nozzles forming a nozzle line extending in a nozzle line direction perpendicular to a conveyance direction while conveying a recording medium by a paper feed roller in the conveyance direction, forming dots on the recording medium, wherein: different nozzle lines that eject ink of the same color are separated in the conveyance direction while overlapping in a specific range in the nozzle line direction, the separation distance of the nozzle lines being a distance corresponding to the conveyance distance of the recording medium when the paper feed roller rotates an integer number of revolutions.

When the recording medium becomes skewed due to eccentricity or skewing of the paper feed roller, the period of one revolution of the paper feed roller matches the period of recording medium skew. As a result, when one nozzle in the group of nozzles in the overlapping range of one nozzle line, and another nozzle corresponding to the one nozzle in the group of nozzles in the overlapping range of another nozzle line, form one dot on the recording medium, the position to which the one nozzle ejects ink to form the one dot, and the position to which the other nozzle ejects ink, can be made to match reflecting the skew period, and a drop in print quality can be suppressed.

In a fluid ejection device according to another aspect of the invention, the separation distance is a distance corresponding to an integer multiple of the outside circumference of the paper feed roller.

This aspect of the invention enables using an objective value, the outside circumference of the paper feed roller, to set the separation distance between nozzle lines with a specific relationship therebetween to a distance corresponding to the conveyance distance of the recording medium when the paper feed roller turns an integer number of revolutions.

In a fluid ejection device according to another aspect of the invention, the first nozzle line and the second nozzle line are both nozzle lines for ejecting black ink.

Dropout of black dots can significantly reduce print quality. As a result, this aspect of the invention can suppress dropout of black dots using black ink, can suppress color dropout and creating areas with uneven color, and can more effectively suppress a drop in print quality.

In a fluid ejection device according to another aspect of the invention, the first nozzle line is a nozzle line for ejecting black ink, and the second nozzle line is a nozzle line for ejecting ink of a color with high optical density.

This aspect of the invention enables ejecting ink of a color with high optical density, that is, a color close to black, at the place where ink dropout occurred when ink dropout occurs where black dots are formed and the recording medium is skewed by the paper feed roller, and can thereby suppress color dropout and can suppress a drop in print quality.

In a fluid ejection device according to another aspect of the invention, the first nozzle line and second nozzle line are nozzle lines for ejecting ink of colors of similar chroma.

When ink dropout occurs in dots of a specific color and the recording medium is skewed by the paper feed roller, this aspect of the invention enables ejecting ink of a color with chroma similar to the chroma of the specific color where ink dropout occurred, and can thereby effectively suppress color dropout and can suppress a drop in print quality.

In a fluid ejection device according to another aspect of the invention, in the nozzle lines that overlap in a specific range in the nozzle line direction, the amount of ink ejected from one of the nozzle lines decreases in the overlapping range from one side to the other side in the nozzle line direction, and the amount of ink ejected from the other nozzle line decreases to the one side in the nozzle line direction.

This aspect of the invention can effectively suppress visual dissonance between the area where dots are formed by the nozzle lines that overlap in a specific range in the nozzle line direction and other areas.

In a fluid ejection device according to another aspect of the invention, black ink is ejected from a nozzle of one nozzle line for ejecting black ink, and ink is ejected from a corresponding nozzle of another nozzle line, to form a black dot.

As noted above, dropout of black dots can significantly reduce print quality.

This aspect of the invention therefore suppresses dropout of black dots and suppresses a drop in print quality by ejecting another ink in addition to black ink to form black dots.

Another aspect of the invention is a method of manufacturing a fluid ejection device that ejects ink from nozzles forming a nozzle line extending in a nozzle line direction perpendicular to a conveyance direction while conveying a recording medium by a paper feed roller in the conveyance direction, forming dots on the recording medium, the manufacturing method producing: a first recording head unit having nozzle lines disposed with a gap therebetween in the conveyance direction, and a second recording head unit that has nozzle lines configured in the same way as the nozzle lines of the first recording head unit and is disposed separated from the first recording head unit in the conveyance direction, so that the first recording head unit and second recording head unit overlap in a specific range in the nozzle line direction, and the separation distance between a first nozzle line in the first recording head unit and a second nozzle line disposed to the second recording head unit at a position corresponding to the first nozzle line is a distance corresponding to the distance offset the conveyance distance of the recording medium in a half revolution of the paper feed roller from the conveyance distance of the recording medium in an integer number of revolutions of the paper feed roller.

The method of manufacturing a fluid ejection device according to this aspect of the invention enables producing a fluid ejection device that can suppress a drop in print quality even when the recording medium is skewed by the paper feed roller.

Another aspect of the invention is a method of manufacturing a fluid ejection device that ejects ink from nozzles forming a nozzle line extending in a nozzle line direction perpendicular to a conveyance direction while conveying a recording medium by a paper feed roller in the conveyance direction, forming dots on the recording medium, the manufacturing method producing different nozzle lines that eject ink of the same color so that the nozzle lines overlap in a specific range in the nozzle line direction, and are separated in the conveyance direction a distance corresponding to the conveyance distance of the recording medium in one revolution of the paper feed roller.

The method of manufacturing a fluid ejection device according to this aspect of the invention enables producing a fluid ejection device that can suppress a drop in print quality even when the recording medium is skewed by the paper feed roller.

EFFECT OF THE INVENTION

The invention enables suppressing a drop in print quality even when the recording medium is skewed by the paper feed roller.

BRIEF DESCRIPTION OF THE DRAWINGS

FIG. 9 is a table showing the optical density (OD) of each color.

DESCRIPTION OF EMBODIMENTS

A preferred embodiment of the present invention is described below with reference to the accompanying figures.

Embodiment 1

Configuration of a Fluid Ejection Device

Figure 1:
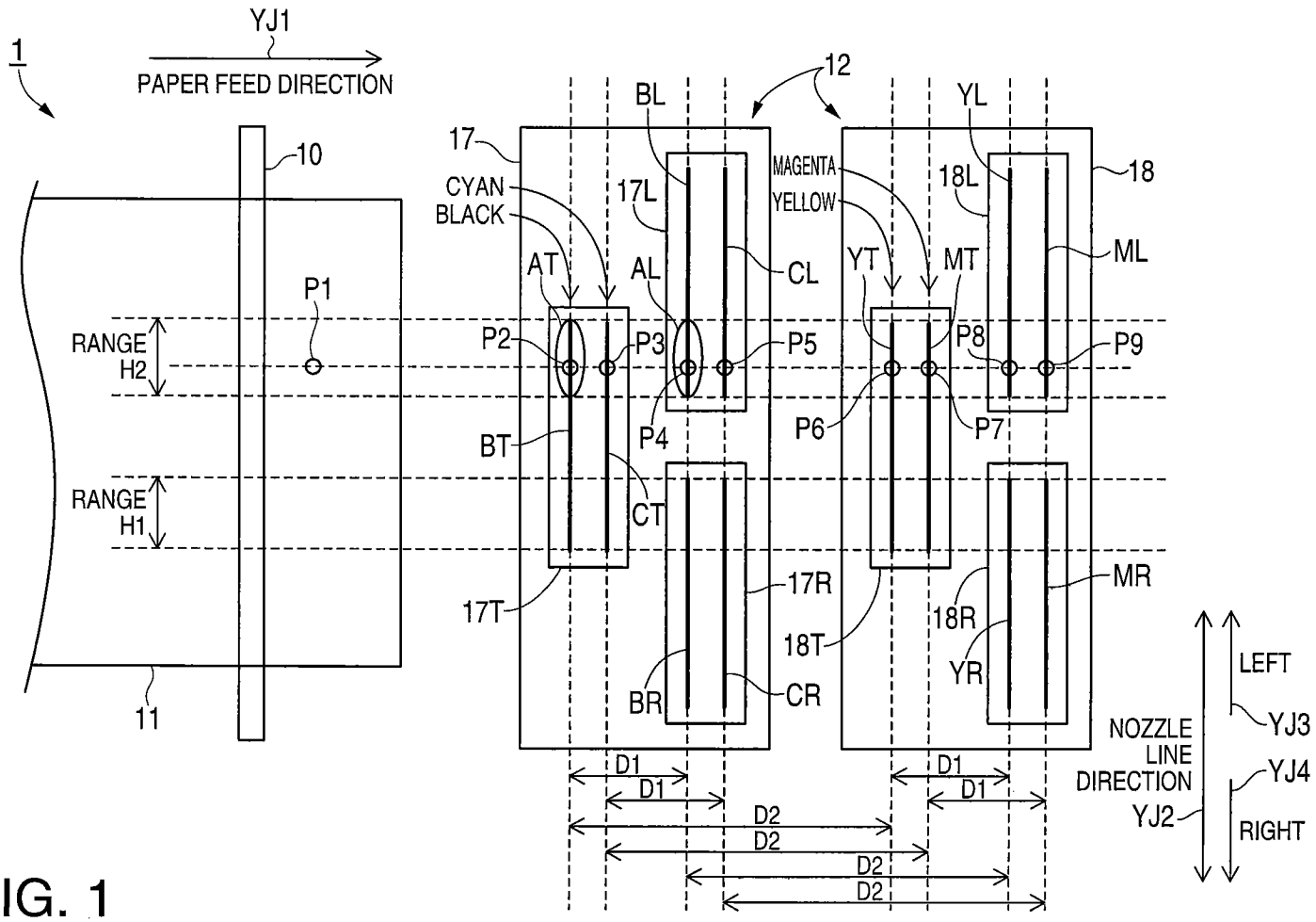
FIG. 1 shows an inkjet line printer according to a first embodiment of the invention.

A fluid ejection device according to this embodiment of the invention is described first with reference to FIG. 1.

FIG. 1 schematically describes the configuration of a fluid ejection device (inkjet line printer 1 below) according to this embodiment of the invention.

The inkjet line printer 1 is an inkjet printer with a line printhead that records images by forming dots on a recording medium 11 by ejecting ink (fluid) from an inkjet line head 12 having a line of nozzles extending in a nozzle line direction YJ2 that is perpendicular to the paper feed direction YJ1 onto the recording medium 11 while conveying the recording medium 11 in the paper feed direction YJ1 by a paper feed roller 10.

As shown in FIG. 1, the inkjet line printer 1 has an upstream head unit 17 (first recording head unit) and a downstream head unit 18 (second recording head unit).

The upstream head unit 17 has three staggered recording heads, upstream top recording head 17T, upstream left recording head 17L, and upstream right recording head 17R. The downstream head unit 18 similarly has three staggered recording heads, downstream top recording head 18T, downstream left recording head 18L, and downstream right recording head 18R.

A black nozzle line BT, and a cyan nozzle line CT disposed downstream from the black nozzle line BT, are disposed to the upstream top recording head 17T of the upstream head unit 17. The range in which the black nozzle line BT extends in the nozzle line direction YJ2, and the range in which the cyan nozzle line CT extends in the nozzle line direction YJ2, match.

The black nozzle line BT is a nozzle line having nozzles that eject ink as fine ink droplets (fluid droplets) formed in the nozzle line direction YJ2, which is perpendicular to the conveyance direction. Ink is supplied to the black nozzle line BT from a black (K) ink cartridge (not shown). The upstream top recording head 17T pushes ink supplied from the black (K) ink cartridge by an actuator rendered by a piezoelectric device, for example, toward the recording medium 11, ejecting fine ink droplets from specific nozzles.

Similarly to the black nozzle line BT, the cyan nozzle line CT is a nozzle line of nozzles formed in the nozzle line direction, and has ink supplied from a cyan (C) ink cartridge (not shown).

The upstream right recording head 17R is configured identically to the upstream top recording head 17T, and has a black nozzle line BR for ejecting black (K) ink, and a cyan nozzle line CR for ejecting cyan ink disposed on the downstream side of the black nozzle line BR.

As shown in FIG. 1, the nozzle lines formed on the upstream top recording head 17T and the nozzle lines formed on the upstream right recording head 17R, overlap in range H1 in the nozzle line direction YJ2. This overlap is set to prevent forming visually dissonant white lines as a result of uneven separation of dots in the area of the boundary between dots formed on the recording medium 11 by the upstream top recording head 17T and dots formed on the recording medium 11 by the upstream right recording head 17R.

As shown in FIG. 1, the black nozzle line BT formed on the upstream top recording head 17T is separated distance D1 in the conveyance direction from the black nozzle line BR formed on the upstream right recording head 17R, and the cyan nozzle line CT and cyan nozzle line CR are also separated distance D1. This distance D1 is further described below.

The upstream left recording head 17L is configured identically to the upstream top recording head 17T, and has a black nozzle line BL and a cyan nozzle line CL downstream from the black nozzle line BL.

As shown in FIG. 1, the nozzle lines of the upstream top recording head 17T, and the nozzle lines of the upstream left recording head 17L overlap in range H2 in the nozzle line direction YJ2.

As shown in FIG. 1, the nozzle lines formed in the upstream top recording head 17T are separated distance D1 in the conveyance direction from the nozzle lines formed in the upstream left recording head 17L.

The black nozzle line BR and black nozzle line BL are at the same position in the conveyance direction, and the cyan nozzle line CR and the cyan nozzle line CL are at the same position in the conveyance direction.

The downstream top recording head 18T has a yellow nozzle line YT, and a magenta nozzle line MT formed downstream from the yellow nozzle line YT. Ink from a yellow (Y) ink cartridge is supplied to the yellow nozzle line YT, and ink from a magenta (M) ink cartridge is supplied to the magenta nozzle line MT. The range of the yellow nozzle line YT in the nozzle line direction YJ2, and the range of the magenta nozzle line MT in the nozzle line direction YJ2, are the same.

The downstream right recording head 18R is configured identically to the downstream top recording head 18T, and has a yellow nozzle line YR that ejects yellow (Y) ink, and a magenta nozzle line MR that ejects magenta (M) ink disposed downstream from the yellow nozzle line YR.

As shown in FIG. 1, the nozzle lines formed in the downstream top recording head 18T overlap the nozzle lines formed in the downstream right recording head 18R in range H1 in the nozzle line direction YJ2.

As also shown in FIG. 1, the nozzle lines of the downstream top recording head 18T are separated distance D1 from the nozzle lines of the downstream right recording head 18R.

The downstream left recording head 18L is configured identically to the downstream top recording head 18T, and has a yellow nozzle line YL that ejects yellow (Y) ink, and a magenta nozzle line ML that ejects magenta (M) ink disposed downstream from the yellow nozzle line YL.

As shown in FIG. 1, the nozzle lines formed in the downstream top recording head 18T overlap the nozzle lines formed in the downstream left recording head 18L in range H1 in the nozzle line direction YJ2.

As also shown in FIG. 1, the nozzle lines of the downstream top recording head 18T are separated distance D1 from the nozzle lines of the downstream left recording head 18L.

The positions of the yellow nozzle line YR and the yellow nozzle line YL in the conveyance direction are the same, and the positions of the magenta nozzle line MR and the magenta nozzle line ML in the conveyance direction are the same.

As shown in FIG. 1, the relative positions of the three recording heads in the upstream head unit 17, and the relative positions of the three recording heads in the downstream head unit 18, are the same.

As also shown in FIG. 1, the distance between the first nozzle lines formed in the first recording heads of the upstream head unit 17, and the nozzle lines formed in the second recording heads of the downstream head unit 18 corresponding to the first recording heads, is a uniform distance D2.

More specifically, the black nozzle line BT of the upstream top recording head 17T of the upstream head unit 17, and the yellow nozzle line YT of the downstream top recording head 18T of the downstream head unit 18, are separated distance D2 in the conveyance direction. The cyan nozzle line CT and magenta nozzle line MT, the black nozzle line BR and yellow nozzle line YR, the cyan nozzle line CR and magenta nozzle line MR, the black nozzle line BL and yellow nozzle line YL, and the cyan nozzle line CL and magenta nozzle line ML, are likewise separated distance D2 in the conveyance direction. How this distance D2 is determined is further described below.

The inkjet line printer 1 ejects ink and forms dots on the recording medium 11, and records images by the combination of dots. The basic operation for forming a single dot on the recording medium 11 is described briefly using FIG. 1.

Forming a dot of a specific color at a desired position P1 on the recording medium 11 when the recording medium 11 is set to a position as shown in FIG. 1 is described below. Note that the specific color is a color that is achieved by ejecting specific amounts of black (K), cyan (C), yellow (Y), and magenta (M) ink.

As shown in FIG. 1, position P1 is a position in range H2.

The inkjet line printer 1 conveys the recording medium 11 in a specific direction at a predetermined constant speed while forming dots on the recording medium 11. As conveyance of the recording medium 11 in the conveyance direction from the position shown in FIG. 1 proceeds, a specific amount of black (K) ink is ejected from the corresponding nozzle of the black nozzle line BT when the position P1 on the recording medium 11 reaches the position corresponding to position P2 of the black nozzle line BT (1). Likewise, a specific amount of cyan (C) ink is ejected from the corresponding nozzle of the cyan nozzle line CT when position P1 on the recording medium 11 reaches the position P3 of the cyan nozzle line CT (2). A specific amount of black (K) ink is ejected from the corresponding nozzle of the black nozzle line BL when position P1 on the recording medium 11 reaches the position P4 of the black nozzle line BL (3). A specific amount of cyan (C) ink is ejected from the corresponding nozzle of the cyan nozzle line CL when position P1 on the recording medium 11 reaches the position P5 of the cyan nozzle line CL (4). A specific amount of yellow (Y) ink is ejected from the corresponding nozzle of the yellow nozzle line YT when position P1 on the recording medium 11 reaches the position P6 of the yellow nozzle line YT (5). A specific amount of magenta (M) ink is ejected from the corresponding nozzle of the magenta nozzle line MT when position P1 on the recording medium 11 reaches the position P7 of the magenta nozzle line MT (6). A specific amount of yellow (Y) ink is ejected from the corresponding nozzle of the yellow nozzle line YL when position P1 on the recording medium 11 reaches the position P8 of the yellow nozzle line YL (7). A specific amount of magenta (M) ink is ejected from the corresponding nozzle of the magenta nozzle line ML when position P1 on the recording medium 11 reaches the position P9 of the magenta nozzle line ML (8).

Specific amounts of black (K), cyan (C), magenta (M), and yellow (Y) ink are thus ejected to position P1 on the recording medium 11, and a dot of a specific color is formed at position P1.

The positions of the recording heads are thus fixed during the process related to recording an image in the inkjet line printer 1 according to this embodiment of the invention, the recording medium 11 moves relative to the stationary recording heads, ink is desirably ejected from the recording heads to form dots, and an image is recorded.

Operation of an Inkjet Line Printer

The operation of an inkjet line printer is described next with reference to FIG. 2.

Figure 2:
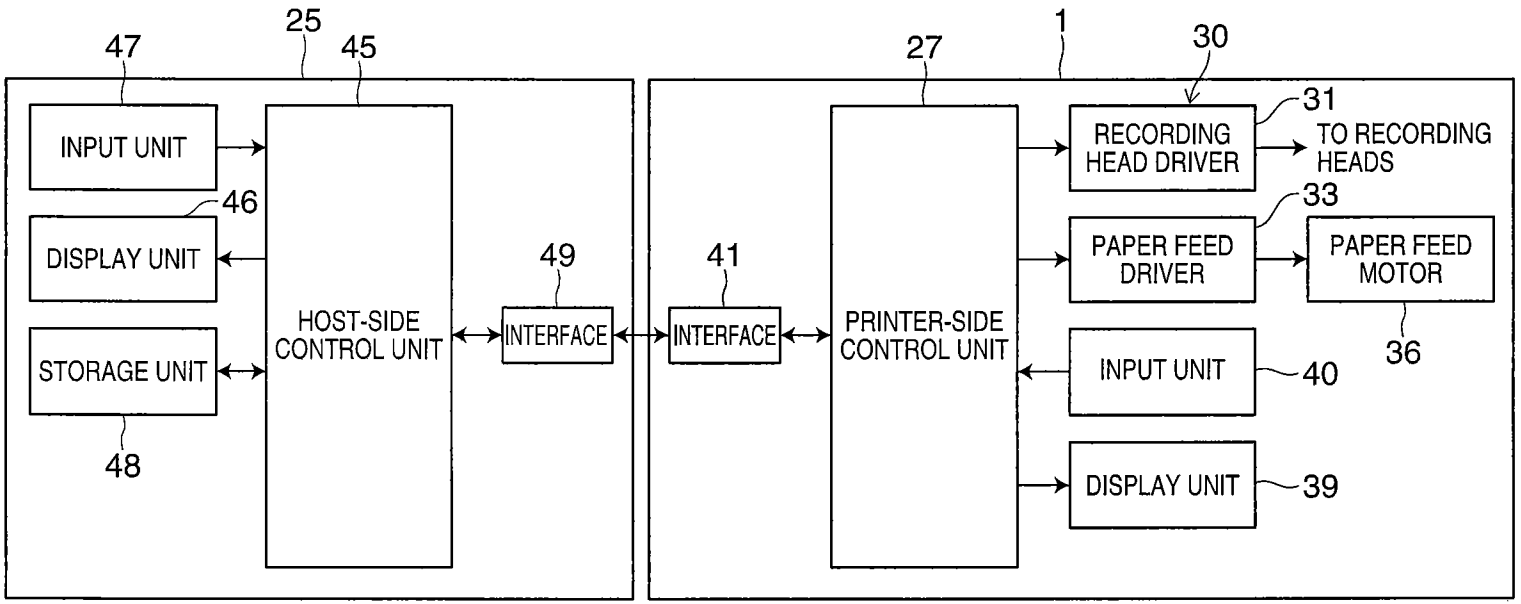
FIG. 2 is a block diagram of the inkjet line printer and host computer.

FIG. 2 is a block diagram showing the functional configuration of the inkjet line printer 1 according to this embodiment of the invention, and a host computer 25 that controls the inkjet line printer 1.

The inkjet line printer 1 includes a printer-side control unit 27 and a driver circuit unit 30.

The printer-side control unit 27 centrally controls parts of the inkjet line printer 1, and includes a CPU as an operating unit, a basic control program that can be executed by the CPU, ROM that nonvolatilely stores this basic control program and data, RAM that temporarily stores the program executed by the CPU and data related to the program, and other peripheral circuits.

The driver circuit unit 30 includes a recording head driver 31 and paper feed driver 33.

The recording head driver 31 is connected to each recording head, and as controlled by the printer-side control unit 27 drives the actuator of each recording head to eject the required amount of ink from the nozzles.

The paper feed driver 33 is connected to the paper feed motor 36, outputs a drive signal to the paper feed motor 36, and causes the paper feed motor 36 to operate only the amount specified by the printer-side control unit 27. As the paper feed motor 36 operates, the paper feed roller 10 turns, and the recording medium 11 is conveyed in the conveyance direction.

A display unit 39, input unit 40, and communication interface 41 are also connected to the printer-side control unit 27.

The display unit 39 has a display panel or LEDs, and displays information as controlled by the printer-side control unit 27.

The input unit 40 is connected to operating switches, detects operation of the switches, and outputs to the printer-side control unit 27.

The communication interface 41 communicates with the host computer 25 according to a specific standard as controlled by the printer-side control unit 27.

The host computer 25 includes a host-side control unit 45, display unit 46, input unit 47, storage unit 48, and communication interface 49.

The host-side control unit 45 centrally controls parts of the host computer 25, and like the printer-side control unit 27 includes a CPU, ROM, RAM, and peripheral circuits.

The display unit 46 is an LCD panel or organic electroluminescent panel, for example, and displays information on the display panel as controlled by the host-side control unit 45.

The input unit 47 is connected to input devices, and outputs output signals from the input devices to the host-side control unit 45.

The storage unit 48 is a storage device such as a hard disk drive or EEPROM device, and stores data rewritably.

Like the communication interface 41 described above, the communication interface 49 exchanges signals with the inkjet line printer 1 as controlled by the host-side control unit 45.

A printer control program such as a printer driver for controlling the inkjet line printer 1 is installed to the host computer 25. The host-side control unit 45 outputs appropriate control commands to the inkjet line printer 1 by reading and running the printer control program.

The printer-side control unit 27 controls parts of the driver circuit unit 30 based on control commands input from the host computer 25, and performs the operation that records images on the recording medium 11.

Print Quality Due to Nozzle Line Overlap

Nozzle line overlap is described next with reference to FIG. 3, FIG. 4, and FIG. 5.

Figure 3:
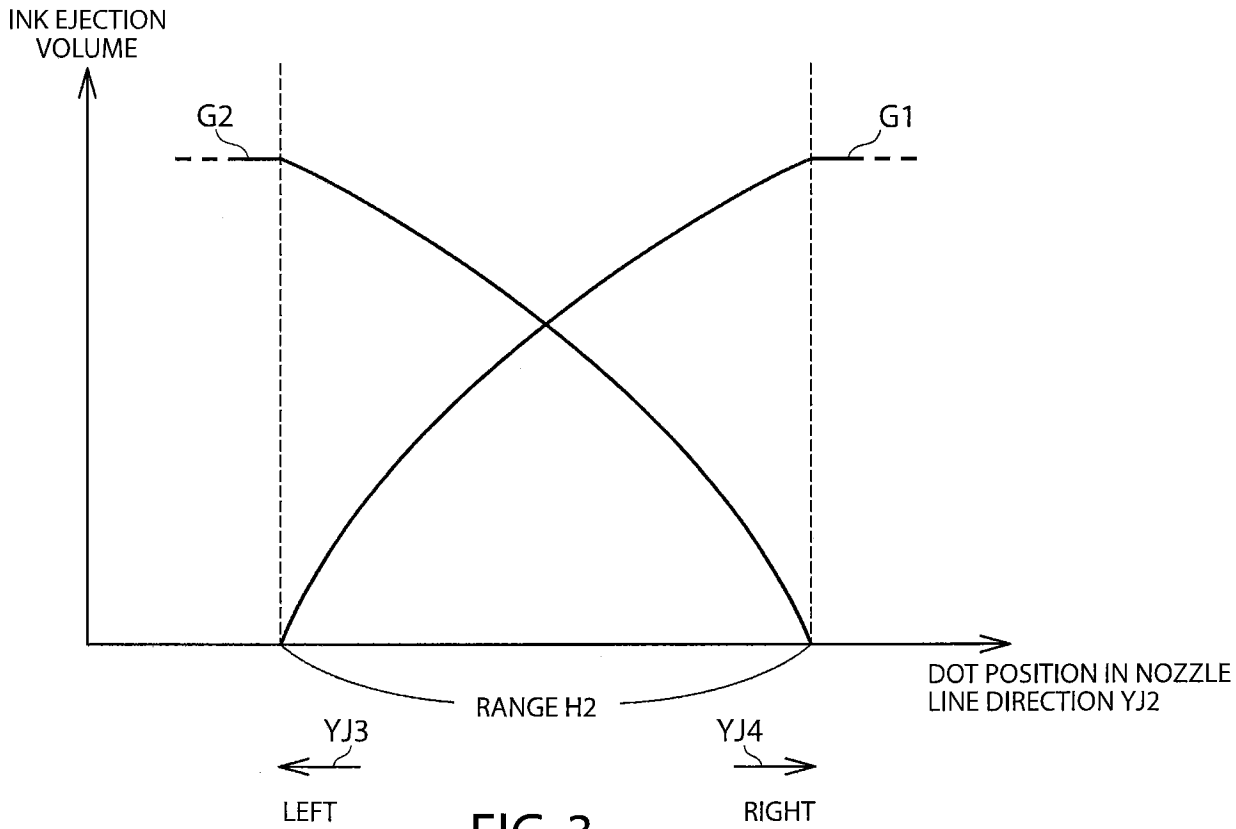
FIG. 3 is a graph of the change in ink ejection volume by a nozzle line.

FIG. 3 shows the change in the ink ejection volume in a nozzle line. FIG. 4 illustrates when the recording medium is skewed. FIG. 5 describes the dots formed by a nozzle line.

Nozzle Line Overlap is Described First.

For brevity, overlap between the black nozzle line BT of the upstream top recording head 17T and the black nozzle line BL of the upstream left recording head 17L is described below.

As shown in FIG. 1, the black nozzle line BT and black nozzle line BL overlap in range H2. The portion of the black nozzle line BT in range H2 is referred to as area AT, and the portion of the black nozzle line BL in the range H2 is area AL.

As described above, to form one dot on the recording medium 11, a specific amount of black (K) ink is ejected from one nozzle in area AT of black nozzle line BT to deposit black (K) ink at the position where the one dot is to be formed (position P1 in this example). A specific amount of black (K) ink is also ejected from the nozzle in area AL of black nozzle line BL to the same position (position P1 in this example). In this case, the amount of ink ejected from the one nozzle and the other nozzle is set appropriately so that the area corresponding to range H1 in the image recorded on the recording medium 11 does not appear visually dissonant due to an inconsistent change in color.

FIG. 3 shows the change in the ink ejection volume of the black nozzle line BT and black nozzle line BL in range H2. In FIG. 3 the x-axis shows the dots formed in the nozzle line direction YJ2 (dot positions in the nozzle line direction YJ2), and the y-axis shows the amount of ink (ink ejection volume). Curve gap G1 shows change in the ink ejection volume of the black nozzle line BT, and curve G2 shows change in the ink ejection volume of the black nozzle line BL. Curves G1 and G2 show change in the ink ejection volume of each nozzle line when a dot of a constant color is formed using black (K) ink.

As shown in FIG. 1, the vector to the left in the nozzle line direction YJ2 relative to the paper feed direction YJ1 is left YJ3, and the vector to the right is right YJ4.

As shown in FIG. 3, the amount of ink ejected from black nozzle line BT in range H2 gradually decreases to the left YJ3, and the amount of ink ejected from black nozzle line BL gradually decreases to the right YJ4, when forming dots of a specific color in range H2.

By controlling the ink ejection volume from each nozzle line in range H2 as shown in FIG. 3, dots in range H2 are formed by ink ejected from both the black nozzle line BT and black nozzle line BL. If the black nozzle line BT and black nozzle line BL did not overlap in part, an area with an uneven dot array will be created at the boundary between dots formed by the black nozzle line BT and dots formed by the black nozzle line BL, resulting in the formation of a white line. The method of the invention, however, can desirably prevent formation of white lines. In addition, as shown in FIG. 3, while the amount of ink ejected from the black nozzle line BT gradually decreases to the left YJ3 in range H2, the amount of ink ejected from the black nozzle line BL increases to the left YJ3, and an uneven change in color due to differences in the ink ejection volume is suppressed for dots in range H2 [H1, sic].

Skewing of the recording medium is described next.

The inkjet line printer 1 according to this embodiment of the invention conveys the recording medium 11 in the conveyance direction by paper feed roller 10. Due to aging, differences between individual parts, and other factors, the paper feed roller 10 can become eccentric. When the paper feed roller 10 becomes eccentric, the recording medium 11 can become skewed as it is conveyed.

Figure 4:
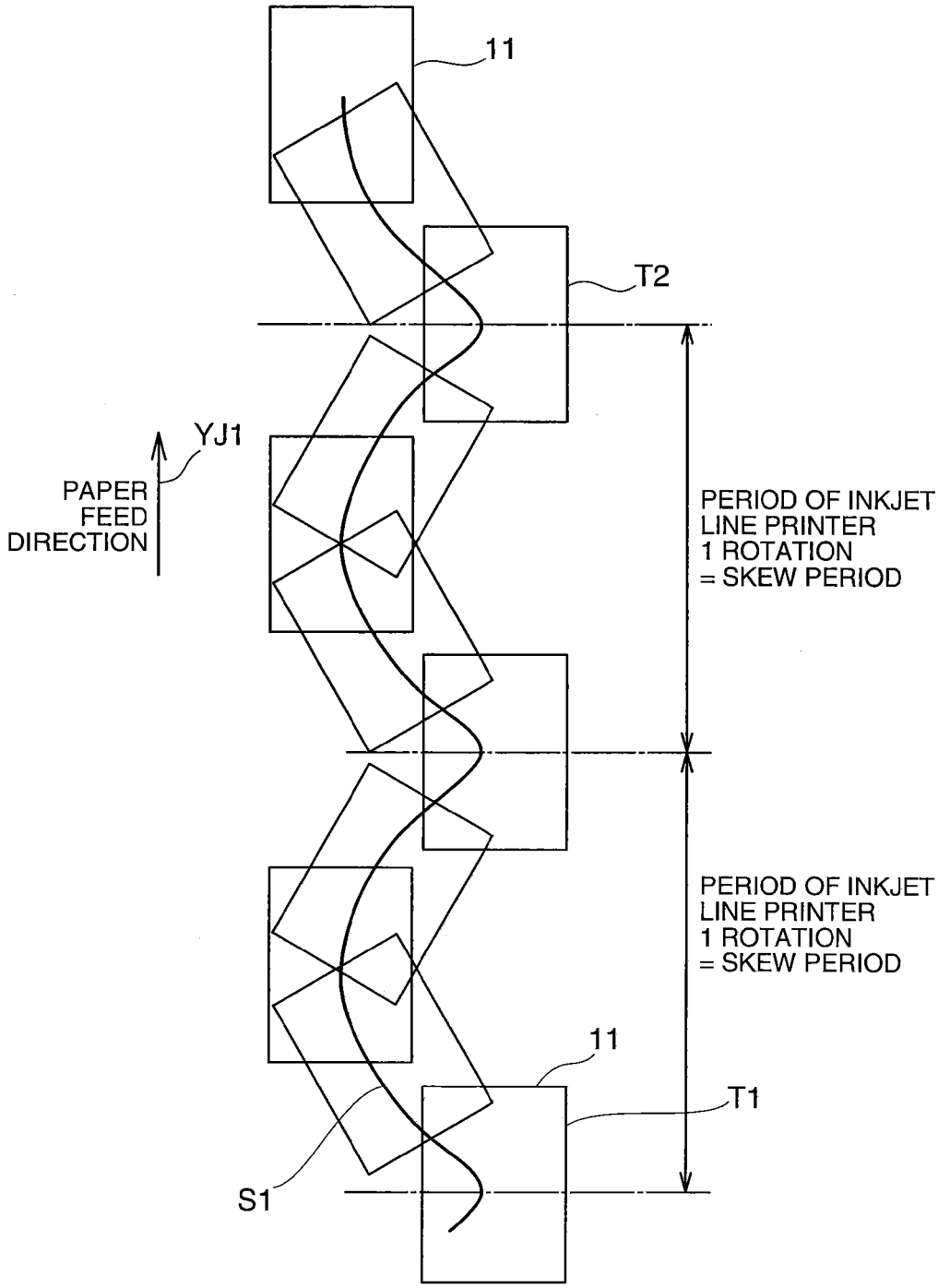
FIG. 4 illustrates skewing of the recording medium.

FIG. 4 describes skewing of the recording medium 11 due to eccentricity of the paper feed roller 10 more specifically. Note that for ease of understanding the size of the recording medium 11 and the skewing behavior of the recording medium 11, skewing of the recording medium 11 is exaggerated in FIG. 4.

Line S1 in FIG. 4 shows the path of the center of the recording medium 11 as it is conveyed in the paper feed direction.

When the recording medium 11 is eccentric, the recording medium 11 can wander as shown in FIG. 4.

When the recording medium 11 is thus skewed by the eccentricity of the paper feed roller 10, the period of one revolution of the paper feed roller 10 will match the period of recording medium 11 skew.

More specifically, assume that the paper feed roller 10 is eccentric and starts rotating from a first state. When the paper feed roller 10 then rotates from this first state, the eccentricity of the roller causes the state of the paper feed roller 10 to change as the roller turns, and the paper feed roller 10 returns to the first state after one revolution.

As a result, if the paper feed roller 10 starts turning with the recording medium 11 at position T1 in FIG. 4, the recording medium 11 is skewed in a specific pattern as the paper feed roller 10 turns, and when the paper feed roller 10 has turned one full revolution, returns to the same position as position T1 (position T2 in FIG. 4).

Print quality is described next.

When forming one dot in the area where the nozzle lines overlap, ink must be ejected to the same place on the recording medium 11 from one nozzle in the first nozzle line (that is, the nozzle at position P2 in the black nozzle line BT) and the other nozzle at the same position in the second nozzle line as the one nozzle in the first nozzle line (the nozzle at position P4 in the black nozzle line BL).

When the recording medium 11 becomes skewed, the skewing causes separation between the position on the recording medium 11 to which ink is ejected by the one nozzle to form one dot, and the position on the recording medium 11 to which ink is ejected by the other nozzle to form one dot, and this separation results in ink dropout and white streaks.

Figure 5:
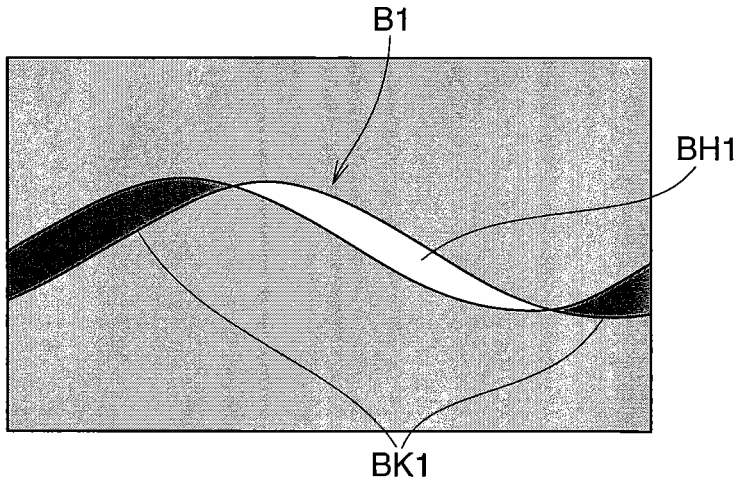
FIG. 5 schematically describes dots formed by the nozzle lines.

FIG. 5 illustrates dots formed by black nozzle line BT and black nozzle line BL when black dots or off-black dots are formed to fill the recording area of the recording medium 11.

Note that FIG. 5 exaggerates the dots formed in the recording area corresponding to range H2, which is the area where black nozzle line BT and black nozzle line BL overlap, when skewing of the recording medium 11 is exaggerated.

In FIG. 5, ribbon B1, which is the ribbon-like area labelled B1 in the figure, is a group of dots resulting from the separation of dots formed by the nozzles in area AT of black nozzle line BT, and the dots formed by the nozzles in area AL of black nozzle line BL, due to skewing of the recording medium 11.

This ribbon B1 includes a high density part BK1 where the color density is higher, and a low density part BH1 resulting from dots not being formed or the formation of dots that are lighter in color, than the surrounding area. This low density part BH1 results when total ink dropout occurs or ink ejection drops and ink dropout is imminent.

The shape of this ribbon B1 changes throughout one revolution of the paper feed roller 10. More specifically, the ribbon B1 shown in FIG. 5 shows the ribbon B1 formed when the recording medium 11 is conveyed through one revolution of the paper feed roller 10, and the pattern shown in FIG. 5 repeats with each one revolution of the paper feed roller 10. That is, ribbon B1 represents the constant pattern that is formed throughout the period of one revolution of the paper feed roller 10. This shape of the ribbon B1 corresponds to the skew, and the skew cycle matches the cycle of one revolution of the paper feed roller 10.

Method of Suppressing a Drop in Print Quality

Figure 6:
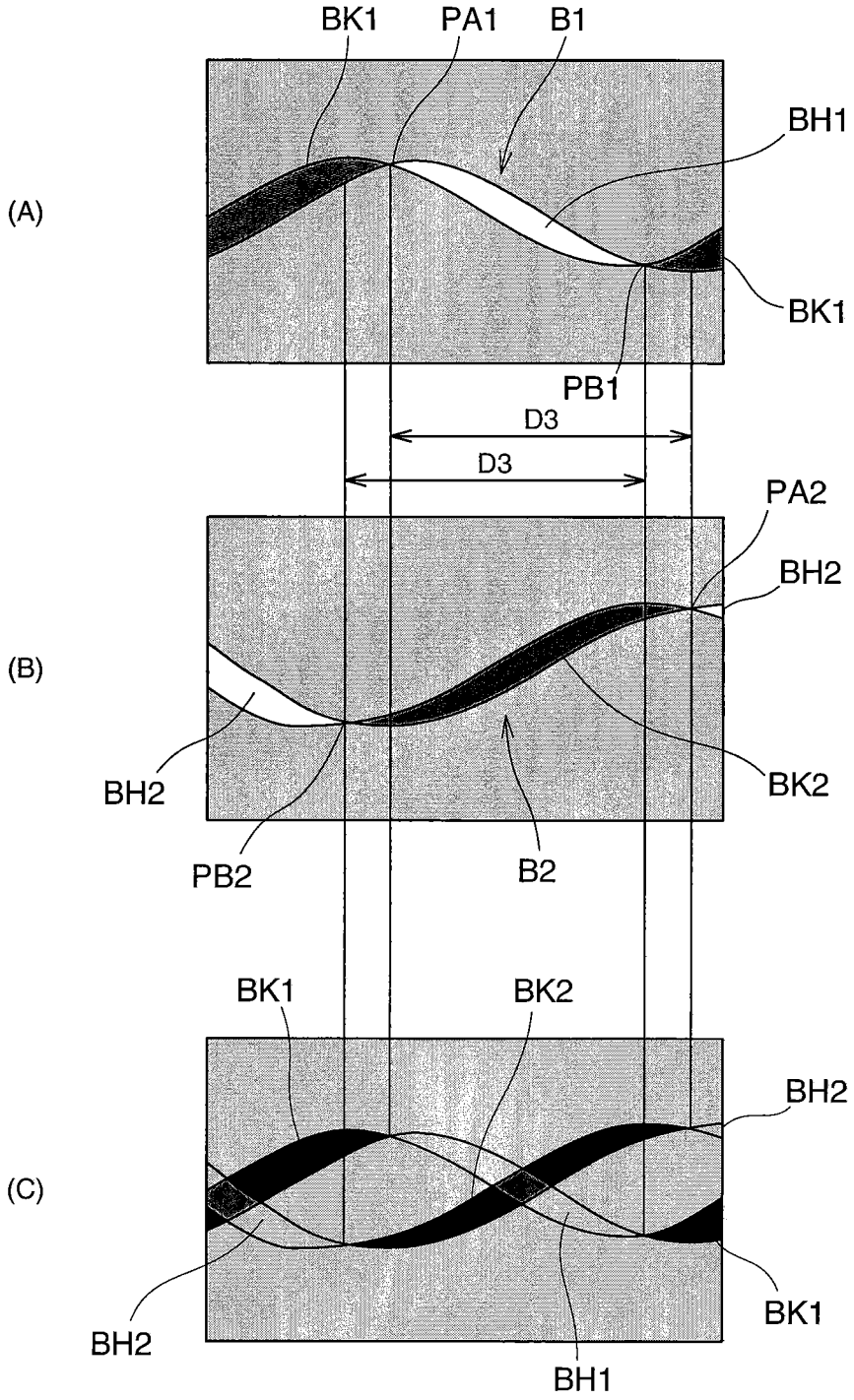
FIG. 6 shows a ribbon that is produced when the recording medium becomes skewed.

A method of suppressing a drop in print quality according to the first embodiment of the invention is described next with reference to FIG. 5 and FIG. 6. FIG. 6 shows a ribbon created by skewing of the recording medium.

The appearance of ink dropout and white streaks when attempting to improve the print quality of an inkjet line printer 1 results in a significant drop in quality. In the example shown in FIG. 5, print quality is reduced by the creation of the low density part BH1. This drop in print quality can therefore be effectively suppressed by suppressing ink dropout.

The invention therefore suppresses ink dropout at the position corresponding to the low density part BH1 by the method described below.

More specifically, in this embodiment of the invention the distance between the black nozzle line BT of the upstream head unit 17 and the yellow nozzle line YT of the downstream head unit 18 corresponding to this black nozzle line BT, and the distance between the black nozzle line BL of the upstream head unit 17 and the yellow nozzle line YL of the downstream head unit 18 corresponding to this black nozzle line BL, is set to the value obtained from the equation $$D2=(n-\tfrac{1}{2})\times L1 \quad (1)$$

(where circumference L1 is the circumference of the paper feed roller 10, and n is a positive integer) plus a specific compensation value.

Note that this specific compensation is applied to absorb individual differences in the inkjet line printer 1 and hardware and software variations, including anticipated error.

In addition, a correspondence between a first nozzle line of the upstream head unit 17 and a second nozzle line of the downstream head unit 18 means that a relative position in the first nozzle line of the upstream head unit 17 and the corresponding relative position in the second nozzle line of the downstream head unit 18 are the same. More specifically, the black nozzle line BT and yellow nozzle line YT, the cyan nozzle line CT and magenta nozzle line MT, the black nozzle line BR and yellow nozzle line YR, the cyan nozzle line CR and magenta nozzle line MR, the black nozzle line BL and yellow nozzle line YL, and the cyan nozzle line CL and magenta nozzle line ML, are corresponding nozzle lines.

The distance between each of these corresponding nozzle lines is the same distance D2.

The recording medium 11 contacts the paper feed roller 10, and is conveyed in the paper feed direction YJ1 in conjunction with rotation of the paper feed roller 10. The length of the circumference L1 therefore corresponds to the conveyance distance of the recording medium 11 in the paper feed direction YJ1 when the paper feed roller 10 turns one revolution.

Calculating distance D2 in this way has the following effect.

More specifically, when the recording medium 11 is skewed by eccentricity of the paper feed roller 10 as described above, the period of one revolution of the paper feed roller 10 and the skew period of the recording medium 11 match, and this period and the period in which the same shape is printed in the group of dots (referred to as simply a "ribbon" below such as the ribbon B1 in FIG. 5) formed by the separation between dots are the same.

By calculating distance D2 from equation 1 shown above, an offset equal to the distance the recording medium is conveyed by a half revolution of the paper feed roller 10 can be created between the ribbon (such as the ribbon formed by the black nozzle line BT and black nozzle line BL) formed by the nozzle lines of the upstream head unit 17 and the ribbon formed by the corresponding nozzle lines of the downstream head unit 18 (the ribbon formed by the yellow nozzle line YT and yellow nozzle line YL).

FIG. 6 describes the relationship between the ribbon B1 formed by the black nozzle line BT and black nozzle line BL, and the ribbon B2 formed by the yellow nozzle line YT and yellow nozzle line YL, when dots are placed on the recording medium 11 in a single continuous operation.

FIG. 6A corresponds to FIG. 5 and shows the dots placed on the recording medium 11 by black nozzle line BT and black nozzle line BL when black or off-black dots are formed over the entire recording area of the recording medium 11.

This embodiment of the invention forms dots using ink of another color in addition to black when forming black and off-black dots instead of using only black ink to form the dots. The reason for this is described below.

When dot dropout occurs (an error resulting from the expected amount of ink not being ejected from a nozzle for some reason and a dot therefore not being formed or not being formed as expected), the dropped dots are most obvious when black dots are dropped, and print quality drops. As a result, when forming black or off-black dots, this embodiment of the invention forms dots by using black ink together with another color of ink. As a result, even if the black ink is not ejected as expected, ink of another color is ejected to the position where the dot should be formed, total dropout of the black dot can be prevented, and the drop in print quality can be suppressed.

The color of the dot formed on the recording medium 11 in FIG. 6A is black or an off-black color, and this color is formed using at least yellow ink instead of only black ink.

FIG. 6B shows a ribbon B2 formed by nozzle line YT and yellow nozzle line YL in the process that formed the dots in FIG. 6A.

FIG. 6A and FIG. 6B show the same area on the recording medium 11 where dots are formed in the same process. FIG. 6A shows the result when ink is ejected only from black nozzle line BT and black nozzle line BL, and FIG. 6B shows the result when ink is ejected only from yellow nozzle line YT and yellow nozzle line YL.

As shown in FIG. 6B, the ribbon B2 has a high density part BK2 and a low density part BH2.

FIG. 6C shows the result when black or off-black dots are formed uniformly on the recording medium 11 and ink is ejected only from black nozzle line BT, black nozzle line BL, yellow nozzle line YT and yellow nozzle line YL. In other words, FIG. 6C combines FIG. 6A and FIG. 6B.

As shown in FIG. 6A and FIG. 6B, the shape of ribbon B1 and the shape of ribbon B2 are the same shape but out of phase. This is because both ribbons result from skewing of the recording medium 11 in the same dot formation process.

The peak of the period in ribbon B1 (the transition point between high density part BK1 and low density part BH1), and the peak of the period in ribbon B2 (the transition point between high density part BK2 and low density part BH2), are offset by distance D3. For example, peak PA1 in ribbon B1 and peak PA2 of ribbon B2 corresponding to peak PA1 are separated distance D3, and peak PB1 in ribbon B1 and peak PB2 in ribbon B2 corresponding to peak PB1 are separated distance D3.

This offset of distance D3 is the offset resulting from setting distance D2 to the value obtained from equation (1) above, and is the distance that the recording medium 11 is conveyed when the paper feed roller 10 turns a half revolution.

This is because by setting distance D2 based on equation (1), after one nozzle of the upstream head unit 17 (such as the nozzle at position P2 in black nozzle line BT) ejects ink to form one dot, ink is ejected from the corresponding other nozzle of the downstream head unit 18 (such as the nozzle at position P6 in yellow nozzle line YT) when the paper feed roller 10 has rotated a half revolution less than an integer number of revolutions (that is, 0.5 revolution, 1.5 revolutions, 2.5 revolutions, and so forth)

More specifically, in equation (1), if n=1, distance D2 is calculated as D2=(1−½)×L1=½×L1. The length of circumference L1 is the conveyance distance of the recording medium 11 in one revolution of the paper feed roller 10. Referring to FIG. 1, after black ink is ejected from the corresponding nozzle of the black nozzle line BT timed to position P1 on the recording medium 11 reaching position P2 of the black nozzle line BT in order to form a dot at position P1 on the recording medium 11, position P1 on the recording medium 11 reaches position P6 of the yellow nozzle line YT simultaneously to the paper feed roller 10 turning another half revolution.

By shifting the peak of the period of ribbon B1 and the peak of the period of ribbon B2 a half revolution of the paper feed roller 10, the low density part BH1 in ribbon B1 and the low density part BH2 in ribbon B2 are offset an equal amount, and an overlap between low density part BH1 and low density part BH2 is eliminated as shown in FIG. 6C. As a result, dots are formed in both low density part BH1 and low density part BH2. More specifically, as shown in FIG. 6C, dots are formed by yellow nozzle line YT and yellow nozzle line YL in low density part BH1, and dots are formed in low density part BH2 by black nozzle line BT and black nozzle line BL. As a result, white streaks in the low density part BH1 and low density part BH2 are suppressed, and a drop in print quality can therefore also be suppressed. More specifically, even when black and off-black dots are formed, dropped dots of black or off-black can be suppressed because the dots are not formed using only black ink, and a drop in print quality can be more effectively suppressed.

Because the period of ribbon B1 and the period of ribbon B2 match the period of one revolution of the paper feed roller 10, the peak of ribbon B1 and the peak of ribbon B2 will be separated the greatest when the peak of the period of ribbon B1 and the peak of the period of ribbon B2 are offset the distance equal to the media conveyance distance when the paper feed roller 10 turns a half revolution, and the probability of an overlap between low density part BH1 and low density part BH2 can be minimized. As a result, distance D2 is set to the value calculated from equation (1) in this embodiment of the invention so that the peak of the period of ribbon B1 and the peak of the period of ribbon B2 are offset the distance equal to the conveyance distance when the paper feed roller 10 turns a half revolution, thereby minimizing the probability of an overlap between low density part BH1 and low density part BH2.

The invention is described above using black nozzle line BT and black nozzle line BL and yellow nozzle line YT and yellow nozzle line YL for example, but this also applies to the other nozzle lines (second nozzle lines) having the same correlation therebetween.

An inkjet line printer 1 according to this embodiment of the invention is manufactured as described below, for example. Distance D2 is determined based on the conditions of the equipment used to manufacture the inkjet line printer 1, design conditions, and other manufacturing-related conditions. In this case, circumference L1 is calculated as L1=D2/(n−½), and a paper feed roller 10 manufactured to the calculated circumference L1 is used in the inkjet line printer 1.

Conversely, if the circumference of the paper feed roller 10 is already set, distance D2 is calculated as D2=(n−½)×L1, and the layout of the nozzle lines of the inkjet line printer 1 and other parts related to the nozzle lines is determined to reflect the calculated distance D2.

As described above, distance D2, which is the distance between the black nozzle line BT and black nozzle line BL (first nozzle lines) in the upstream head unit 17 (first recording head unit) and the yellow nozzle line YT and yellow nozzle line YL (second nozzle lines) in the downstream head unit 18 (second recording head unit), is set in this embodiment to a distance corresponding to the distance the recording medium 11 is conveyed in one-half revolution of the paper feed roller 10 from the conveyance distance of the recording medium 11 when the paper feed roller 10 rotates an integer number of revolutions.

As a result, the low density part BH1 (part where ink dropout occurs) of the ribbon B1 formed by the black nozzle line BT and black nozzle line BL due to recording medium 11 skew, and the low density part BH2 (part where ink dropout occurs) of the ribbon B2 formed by the yellow nozzle line YT and yellow nozzle line YL, will be offset a distance corresponding to a half revolution of the paper feed roller 10, that is, will be offset the greatest amount due to eccentricity in the paper feed roller 10. As a result, ink can be ejected and dots formed in the low density part BH1 by yellow nozzle line YT and yellow nozzle line YL, ink can be ejected and dots formed in the low density part BH2 by black nozzle line BT and black nozzle line BL, ink dropout and streaking can be effectively suppressed, and a drop in print quality can be suppressed.

In this embodiment distance D2 is set to a value corresponding to the value calculated by equation (1), D2=(n−½)×L1.

As a result, distance D2 can be set using an objective value, that is, the circumference of the paper feed roller 10.

When a dot of a certain color is formed in range H2 in this as shown in FIG. 3, the amount of ink ejected from black nozzle line BT gradually decreases to the left YJ3, and the amount of ink ejected from black nozzle line BL gradually decreases to the right YJ4, in range H2. As a result, dots in range H2 are formed by ejecting ink from both black nozzle line BT and black nozzle line BL. However, if the black nozzle line BT and black nozzle line BL do not overlap in part, an area where the dot alignment is not uniform can occur at the boundary between dots formed by black nozzle line BT and dots formed by black nozzle line BL, and white streaks can occur as a result. Such white streaks can, however, be desirably prevented by the configuration of the invention described herein. More specifically, as shown in FIG. 3, the amount of ink ejected from the black nozzle line BL increases to the left YJ3 in inverse proportion to the decrease in the amount of ink ejected from the black nozzle line BT to the left YJ3 in range H2 in this embodiment, and an uneven change in color caused by differences in the amount of ejected ink can be suppressed in the dots in range H2.

This embodiment of the invention forms dots using ink of another color in addition to black when forming black and off-black dots instead of using only black ink to form the dots. The reason for this is described below.

When dot dropout occurs (an error resulting from the expected amount of ink not being ejected from a nozzle for some reason and a dot therefore not being formed or not being formed as expected), the dropped dots are most obvious when black dots are dropped, and print quality drops. As a result, when forming black or off-black dots, this embodiment of the invention forms dots by using black ink together with another color of ink. As a result, even if the black ink is not ejected as expected, ink of another color is ejected to the position where the dot should be formed, total dropout of the black dot can be prevented, and the drop in print quality can be suppressed.

Embodiment 2

Figure 7:
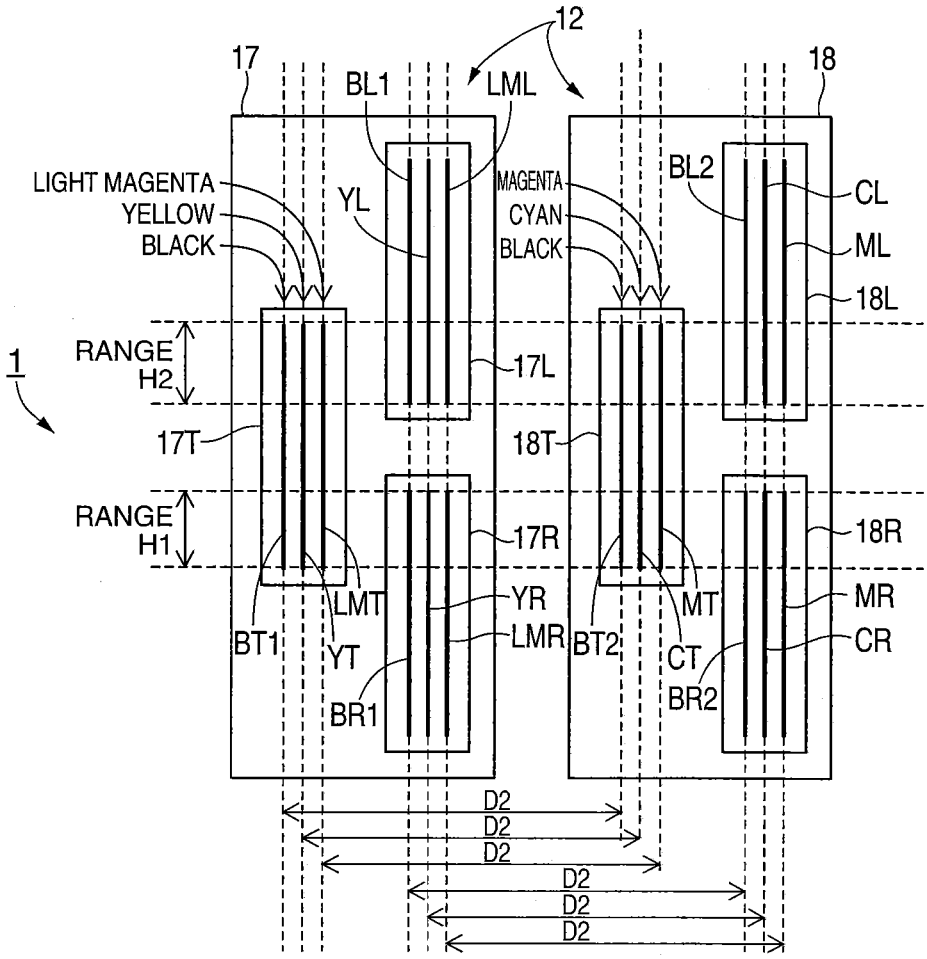
FIG. 7 shows an inkjet line printer according to a second embodiment of the invention.

A second embodiment of the invention is described next with reference to FIG. 7. FIG. 7 schematically describes the configuration of an inkjet line printer 1 according to the second embodiment of the invention. Note that like parts and content in this and the first embodiment are identified by like reference numerals, and further description thereof is omitted.

As will be known by comparing FIG. 7 and FIG. 1, the inkjet line printer 1 according to the first embodiment of the invention and the inkjet line printer 1 according to this embodiment of the invention differ in the configuration of the nozzle lines on each recording head.

More specifically, the upstream top recording head 17T of the upstream head unit 17 has a first black nozzle line BT1 for ejecting black ink, a yellow nozzle line YT for ejecting yellow ink on the downstream side of the first black nozzle line BT1, and a light magenta nozzle line LMT for ejecting light magenta ink downstream from the yellow nozzle line YT. The upstream right recording head 17R and upstream left recording head 17L are similarly configured with the upstream right recording head 17R having a first black nozzle line BR1, yellow nozzle line YR, and a light magenta nozzle line LMR, and the upstream left recording head 17L having a first black nozzle line BL1, yellow nozzle line YL, and light magenta nozzle line LML.

In the downstream head unit 18, the downstream top recording head 18T has a second black nozzle line BT2 for ejecting black ink, a cyan nozzle line CT for ejecting cyan ink, and a magenta nozzle line MT for ejecting magenta ink. The downstream right recording head 18R and downstream left recording head 18L have similar nozzle line configurations with the downstream right recording head 18R having a second black nozzle line BR2, a cyan nozzle line CR, and a magenta nozzle line MR, and the downstream left recording head 18L having a second black nozzle line BL2, cyan nozzle line CL, and magenta nozzle line ML.

The distance between the first nozzle lines of the upstream head unit 17 and the second nozzle lines of the downstream head unit 18 is distance D2. For example, the distance between first black nozzle line BT1 and second black nozzle line BT2 is distance D2, and distance D2 is a value corresponding to the value obtained from equation (1) described above.

A first feature of an inkjet line printer 1 according to this embodiment of the invention is that a black nozzle line is disposed to corresponding positions of the upstream head unit 17 and downstream head unit 18. More specifically, first black nozzle lines BT1, BR1, BL1 are disposed to the upstream head unit 17, and second black nozzle lines BT2, BR2, BL2 are disposed to corresponding positions on the downstream head unit 18.

An effect of this configuration is described below.

Referring to FIG. 6, when a black or off-black dot is formed on the recording medium 11, the ribbon formed by the first black nozzle line BT1 and first black nozzle line BL1 due to skewing of the recording medium 11 is ribbon B1 shown in FIG. 6A, and the ribbon formed by second black nozzle line BT2 and second black nozzle line BL2 is ribbon B2 in FIG. 6B.

Because distance D2 is calculated from equation (1) above, black ink is ejected from second black nozzle line BT2 and second black nozzle line BL2, and dots are formed in the area corresponding to low density part BH1 of ribbon B1; black ink is ejected from first black nozzle line BT1 and first black nozzle line BL1, and dots are formed in the area corresponding to low density part BH2 in ribbon B2; and dropout and streaking are suppressed in low density parts BH1 and BH2.

In this embodiment of the invention dots are formed with black ink in the areas corresponding to low density parts BH1 and BH2. This configuration separates the colors in low density parts BH1 and BH2 from the colors in other areas more than when dots of a non-black color are formed in low density parts BH1 and BH2, better suppresses uneven changes in color, and better improves print quality. More specifically, by forming black dots with black ink, this embodiment can compensate for ink dropout in dots that are black, which is the color for which preventing ink dropout is particularly important when compared with other colors, and print quality can be improved more effectively.

A second feature of the inkjet line printer 1 according to this embodiment of the invention is the presence of nozzle lines for ejecting ink of colors with similar chroma at corresponding positions on the upstream head unit 17 and downstream head unit 18. More specifically, magenta nozzle lines MT, MR, ML are disposed to positions on the downstream head unit 18 corresponding to the positions of the light magenta nozzle lines LMT, LMR, LML disposed to the upstream head unit 17. As known from the literature, light magenta and magenta are colors with similar chroma.

The effect of this feature is described below.

Referring to FIG. 6, when dots of a color expressed by using both light magenta and magenta are formed on the recording medium 11, ribbon B1 in FIG. 6A is the ribbon formed by light magenta nozzle line LMT and light magenta nozzle line LML due to skewing of the recording medium 11, and ribbon B2 in FIG. 6B is the ribbon formed by magenta nozzle line MT and magenta nozzle line ML.

Because distance D2 is calculated from equation (1), magenta ink is ejected from magenta nozzle line MT and magenta nozzle line ML and dots are formed in the area corresponding to the low density part BH1 of ribbon B1. Light magenta ink is ejected from the light magenta nozzle line LMT and light magenta nozzle line LML, and dots are formed in the area corresponding to low density part BH2 of ribbon B2. As a result, color dropout is suppressed in low density parts BH1 and BH2.

In this embodiment, dots are formed using ink of like chroma in the areas corresponding to low density parts BH1 and BH2. Compared with forming dots using only inks of different chroma in low density parts BH1 and BH2, the color in low density parts BH1 and BH2 is therefore distinct from the color in other areas, uneven changes in color can be suppressed, and print quality can be further improved.

As described above, black nozzle lines are disposed at corresponding positions on the upstream head unit 17 and downstream head unit 18 in this embodiment of the invention. More specifically, first black nozzle lines BT1, BR1, BL1 are disposed to the upstream head unit 17, and second black nozzle lines BT2, BR2, BL2 are disposed to corresponding positions of the downstream head unit 18.

As a result, ink dropout of black dots, which is the color that requires better prevention of ink dropout than other colors, can be compensated for by forming dots of black ink, and print quality can be improved more effectively.

In this embodiment of the invention magenta nozzle lines MT, MR, ML are disposed to positions on the downstream head unit 18 corresponding to the positions of the light magenta nozzle lines LMT, LMR, LML disposed to the upstream head unit 17. As known from the literature, light magenta and magenta are colors with similar chroma.

As a result, dots are formed using ink of like chroma in the areas corresponding to low density parts BH1 and BH2. Compared with forming dots using only inks of different chroma in low density parts BH1 and BH2, the color in low density parts BH1 and BH2 is therefore distinct from the color in other areas, uneven changes in color can be suppressed, and print quality can be further improved.

Embodiment 3

Figure 8:
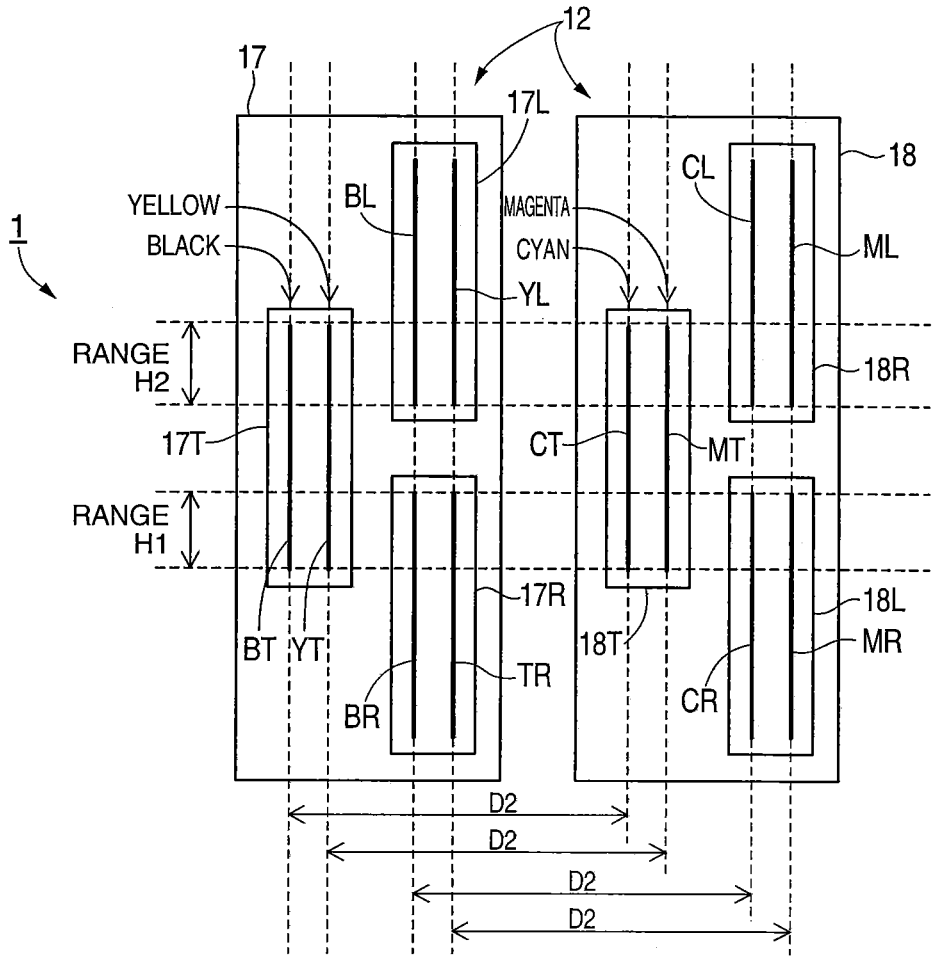
FIG. 8 shows an inkjet line printer according to a third embodiment of the invention.

A third embodiment of the invention is described next with reference to FIG. 8. FIG. 8 schematically describes the configuration of an inkjet line printer 1 according to the third embodiment of the invention. Note that like parts and content in this and the first and second embodiments are identified by like reference numerals, and further description thereof is omitted.

As will be known by comparing FIG. 8 and FIG. 1, the inkjet line printer 1 according to the first embodiment of the invention and the inkjet line printer 1 according to this embodiment of the invention differ in the configuration of the nozzle lines on each recording head.

More specifically, the upstream top recording head 17T of the upstream head unit 17 has a black nozzle line BT for ejecting black ink and a yellow nozzle line YT for ejecting yellow ink on the downstream side of the black nozzle line BT. The upstream right recording head 17R and upstream left recording head 17L are similarly configured with the upstream right recording head 17R having a black nozzle line BR and yellow nozzle line YR, and the upstream left recording head 17L having a black nozzle line BL and yellow nozzle line YL.

The downstream top recording head 18T of the downstream head unit 18 has a cyan nozzle line CT for ejecting cyan ink, and a magenta nozzle line MT for ejecting magenta ink. The downstream right recording head 18R and downstream left recording head 18L have similar nozzle line configurations, the downstream right recording head 18R having a cyan nozzle line CR and magenta nozzle line MR, and the downstream left recording head 18L having a cyan nozzle line CL and magenta nozzle line ML.

The distance between the first nozzle line of the upstream head unit 17 and the second nozzle line of the downstream head unit 18 corresponding to the first nozzle line is distance D2. For example, the distance between black nozzle line BT and cyan nozzle line CT is distance D2, and distance D2 is a value corresponding to the value calculated from equation (1) above.

A feature of the inkjet line printer 1 according to this embodiment of the invention is the black nozzle lines of the upstream head unit 17, and the disposition of nozzle lines for ejecting ink with high optical density (OD) at corresponding positions on the downstream head unit 18.

FIG. 9 is a table showing the optical density (OD) values of black, cyan, magenta, and yellow.

As shown in FIG. 9, the color with the next highest optical density after black is cyan, followed by magenta and then yellow. In other words, not including black, the color with the highest OD is cyan. As known from the literature, the higher the optical density, the closer a color is to black.

In the inkjet line printer 1 according to this embodiment of the invention, black nozzle lines BT, BR, BL are disposed to the upstream head unit 17, and cyan nozzle lines CT, CR, CL for ejecting cyan ink, which is a color with high optical density, are disposed to corresponding positions of the downstream head unit 18.

The effect of this feature is described below.

Referring to FIG. 6, when dots of a color expressed by using both black and cyan are formed on the recording medium 11, ribbon B1 in FIG. 6A is the ribbon formed by black nozzle line BT and black nozzle line BL due to skewing of the recording medium 11, and ribbon B2 in FIG. 6B is the ribbon formed by cyan nozzle line CT and cyan nozzle line CL.

Because distance D2 is calculated from equation (1), cyan ink is ejected from cyan nozzle line CT and cyan nozzle line CL and dots are formed in the area corresponding to the low density part BH1 of ribbon B1. Black ink is ejected from the black nozzle line BT and black nozzle line BL and dots are formed in the area corresponding to low density part BH2 of ribbon B2. As a result, color dropout is suppressed in low density parts BH1 and BH2.

In this embodiment, dots are formed using ink of a color that is close to black with high optical density in the low density part BH1. Compared with forming dots of a color with low optical density in low density part BH1, the color of low density part BH1 is therefore distinct from the color in other areas, uneven changes in color can be suppressed, and print quality can be further improved. As a result, ink dropout of black dots, which is the color that requires better prevention of ink dropout than other colors, can be compensated for by forming dots using ink of a color close to black that has high optical density, and print quality can be improved more effectively.

As described above, black nozzle lines are disposed to the upstream head unit 17 and nozzle lines for ejecting ink of a color with high optical density are disposed to corresponding positions on the downstream head unit 18. More specifically, black nozzle lines BT, BR, BL are disposed to the upstream head unit 17, and cyan nozzle lines CT, CR, CL for ejecting cyan ink, which is a color with high optical density, are disposed to corresponding positions on the downstream head unit 18.

As a result, dots are formed using ink of a color that is close to black with high optical density in the low density part BH1. Compared with forming dots of a color with low optical density in low density part BH1, the color of low density part BH1 is therefore distinct from the color in other areas, uneven changes in color can be suppressed, and print quality can be further improved. As a result, ink dropout of black dots, which is the color that requires better prevention of ink dropout than other colors, can be compensated for by forming dots using ink of a color close to black that has high optical density, and print quality can be improved more effectively.

The invention is described above using preferred embodiments thereof, but the invention is not limited to these embodiments and can be modified and adapted in many ways without departing from the scope of the accompanying claims.

For example, distance D2 is calculated as $D2=(n-\frac{1}{2})\times L1$ in this embodiment, but distance D2 is not so limited. More specifically, distance D2 is set to a distance corresponding to the distance the recording medium 11 is conveyed in a half revolution of the paper feed roller 10 from the conveyance distance of the recording medium 11 when the paper feed roller 10 turns a full revolution. "Corresponding" as used here means a correspondence sufficient to achieve an offset of one-half revolution of the paper feed roller 10 between one ribbon and another ribbon corresponding to the one ribbon.

The location and configuration of the recording heads, and the mechanism and method of recording, are also obviously not limited to the foregoing embodiment. More specifically, the invention can be broadly used with recording devices that record by ejecting ink from nozzles of nozzle lines extending in the nozzle line direction YJ2 onto a recording medium 11 conveyed in the paper feed direction YJ1.

Embodiment 4

A fourth embodiment of the invention is described next. Note that like parts and content in this and the first and second embodiments are identified by like reference numerals, and further description thereof is omitted.

When forming one dot in the range where the nozzle lines overlap, ink must be ejected to the same place on the recording medium 11 from one nozzle in one nozzle line and another nozzle at the same position in another nozzle line as the one nozzle in the one nozzle line, and when ink is ejected from these nozzles to the same place, visual dissonance can be minimized in the area where the nozzle lines overlap. When one dot is formed in range H1 in the example in FIG. 3, ink must be ejected to the same place from corresponding nozzles in the black nozzle line BT and the black nozzle line BL.

Therefore, as described above, ink must be ejected to the same place from both one nozzle and another nozzle corresponding to the one nozzle to form one dot in the overlapping area even when the recording medium 11 becomes skewed due to eccentricity of the paper feed roller 10.

To meet this need, the distance D1 between one nozzle line and the corresponding other nozzle line that overlaps the one nozzle line is designed as described below in this embodiment.

More specifically, distance D1 is set to the sum of D1=L1×n (where circumference L1 is the circumference of the paper feed roller 10, and n is a positive integer) plus a specific compensation factor.

Note that the recording medium 11 contacts the paper feed roller 10, and is conveyed in the paper feed direction YJ1 in conjunction with rotation of the paper feed roller 10. The length of the circumference L1 therefore corresponds to the conveyance distance of the recording medium 11 in the paper feed direction YJ1 when the paper feed roller 10 turns one revolution.

The effect of determining distance D1 in this way is described below.

More specifically, when the recording medium 11 is skewed by eccentricity of the paper feed roller 10, the period of one revolution of the paper feed roller 10 and the skew period of the recording medium 11 are the same. As a result, when ink is ejected by one nozzle to form one dot and the other nozzle then ejects ink timed to the paper feed roller 10 turning an integer number of revolutions, the period of one revolution of the paper feed roller 10 will match the skew period of the recording medium 11. Reflecting this, the position to which ink is ejected by one nozzle to form one dot, and the position to which ink is ejected by the other nozzle, can be made to match.

More specifically, one dot of a specific color (a color achieved by using black (K) in this example) is formed at position P1 on the recording medium 11 as described below with reference to FIG. 1. When the nozzle located at position P4 in black nozzle line BL ejects ink timed to the paper feed roller 10 turning an integer number of revolutions after a specific amount of black (K) ink is ejected by the nozzle located at position P2 in black nozzle line BT, the condition of the recording medium 11 when black (K) ink is ejected by the nozzle of the black nozzle line BT, and the condition of the recording medium 11 when black (K) ink is ejected by the nozzle of the black nozzle line BL, will be same regardless of eccentricity in the paper feed roller 10. More specifically, because the period of one revolution of the paper feed roller 10 and the skew period of the recording medium 11 are the same, the position to which ink is ejected by the one nozzle to form one dot and the position to which the other nozzle ejects ink can be made to match desirably.

This embodiment therefore adds a specific compensation factor to the value of distance D1 calculated as D1=L1×n. As a result, after ink is ejected by one nozzle to form one dot, ink is then ejected from another nozzle timed to an integer number of revolutions of the paper feed roller 10, and because the period of one revolution of the paper feed roller 10 and the skew period of the recording medium 11 are the same, the position to which ink is ejected by the one nozzle and the position to which the other nozzle ejects ink to form one dot can be made to match desirably. A drop in print quality can thereby be suppressed.

Note that this specific compensation is applied to absorb individual differences in the inkjet line printer 1 and hardware and software variations, including anticipated error.

An inkjet line printer 1 according to this embodiment of the invention is manufactured as described below, for example.

Distance D1 is determined based on the conditions of the equipment used to manufacture the inkjet line printer 1, design conditions, and other manufacturing-related conditions. In this case, circumference L1 is calculated as L1=D1/n, and a paper feed roller 10 manufactured to the calculated circumference L1 is used in the inkjet line printer 1.

Conversely, if the circumference of the paper feed roller 10 is already set, distance D1 is calculated as D1=L1×n, and the layout of the nozzle lines of the inkjet line printer 1 and other parts related to the nozzle lines is determined to reflect the calculated distance D1.

As described above, the inkjet line printer 1 according to this embodiment of the invention has a black nozzle line BT and black nozzle line BL, which are different nozzle lines ejecting the same color of ink, disposed overlapping in range H2 in the nozzle line direction YJ2 and with distance therebetween in the paper feed direction YJ1. Distance D1, which is the distance between these nozzle lines, is the distance corresponding to the conveyance distance of the recording medium 11 when the paper feed roller 10 rotates an integer number of revolutions. The inkjet line printer 1 is manufactured to achieve this configuration.

As a result, when one dot of a specific color (a color achieved by using black (K) in this example) is formed at position P1 on the recording medium 11, the nozzle located at position P4 in black nozzle line BL ejects ink timed to the paper feed roller 10 turning an integer number of revolutions after a specific amount of black (K) ink is ejected by the nozzle located at position P2 in black nozzle line BT. The condition of the recording medium 11 when black (K) ink is ejected by the nozzle of the black nozzle line BT, and the condition of the recording medium 11 when black (K) ink is ejected by the nozzle of the black nozzle line BL, will be same regardless of eccentricity in the paper feed roller 10, and because the period of one revolution of the paper feed roller 10 and the skew period of the recording medium 11 are the same, the position to which ink is ejected by the one nozzle to form one dot and the position to which the other nozzle ejects ink can be made to match desirably, and a drop in print quality can therefore be suppressed.

Distance D1 in this embodiment is calculated from D1=L1×n. In other words, distance D1 is a distance that is an integer multiple of the circumference L1 of the paper feed roller 10.

As a result, the distance between nozzle lines with a specific relationship therebetween can be set using the objective value of the circumference L1 of the paper feed roller 10 to a distance corresponding to the conveyance distance of the recording medium 11 when the paper feed roller 10 turns an integer number of revolutions.

When a dot of a certain color is formed in range H2 in this as shown in FIG. 3, the amount of ink ejected from black nozzle line BT gradually decreases to the left YJ3, and the amount of ink ejected from black nozzle line BL gradually decreases to the right YJ4, in range H2. As a result, dots in range H2 are formed by ejecting ink from both black nozzle line BT and black nozzle line BL. However, if the black nozzle line BT and black nozzle line BL do not overlap in part, an area where the dot alignment is not uniform can occur at the boundary between dots formed by black nozzle line BT and dots formed by black nozzle line BL, and white streaks can occur as a result. Such white streaks can, however, be desirably prevented by the configuration of the invention described herein. More specifically, as shown in FIG. 3, the amount of ink ejected from the black nozzle line BL increases to the left YJ3 in inverse proportion to the decrease in the amount of ink ejected from the black nozzle line BT to the left YJ3 in range H2 in this embodiment, and an uneven change in color caused by differences in the amount of ejected ink can be suppressed in the dots in range H2.

The invention is described above using preferred embodiments thereof, but the invention is not limited to these embodiments and can be modified and adapted in many ways without departing from the scope of the accompanying claims.

For example, distance D1 is calculated as D1=L1×n in this embodiment, but distance D1 is not so limited. More specifically, distance D1 is a distance corresponding to the distance the recording medium 11 is conveyed in an integer number of revolutions of the paper feed roller 10. "Corresponding" as used here means a correspondence sufficient to match the position to which ink is ejected from one nozzle with the position to which ink is ejected by another nozzle in the skew cycle to form a single dot.

The location and configuration of the recording heads, and the mechanism and method of recording, are also obviously not limited to the foregoing embodiment. More specifically, the invention can be broadly used with recording devices that record by ejecting ink from nozzles of nozzle lines extending in the nozzle line direction YJ2 onto a recording medium 11 conveyed in the paper feed direction YJ1.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A fluid ejection device that ejects ink from nozzles forming a nozzle line extending in a nozzle line direction perpendicular to a conveyance direction while conveying a recording medium by a paper feed roller in the conveyance direction, forming dots on the recording medium, the fluid ejection device comprising:

a first recording head unit having nozzle lines disposed with a gap therebetween in the conveyance direction, and a second recording head unit that has nozzle lines configured in the same way as the nozzle lines of the first recording head unit and is disposed separated from the first recording head unit in the conveyance direction, the first recording head unit and second recording head unit disposed overlapping in a specific range in the nozzle line direction, and the separation distance between a first nozzle line in the first recording head unit and a second nozzle line disposed to the second recording head unit at a position corresponding to the first nozzle line being a distance corresponding to the distance offset the conveyance distance of the recording medium in a half revolution of the paper feed roller from the conveyance distance of the recording medium in an integer number of revolutions of the paper feed roller.

2. The fluid ejection device described in claim 1, wherein:

the separation distance is a distance corresponding to the outside circumference of the paper feed roller multiplied by (n−½) (where n is a positive integer).

3. The fluid ejection device described in claim 1, wherein:

the first nozzle line and the second nozzle line are both nozzle lines for ejecting black ink.

4. The fluid ejection device described in claim 1, wherein:

the first nozzle line is a nozzle line for ejecting black ink, and the second nozzle line is a nozzle line for ejecting ink of a color with high optical density.

5. The fluid ejection device described in claim 1, wherein:

the first nozzle line and second nozzle line are nozzle lines for ejecting ink of colors of similar chroma.

6. The fluid ejection device described in claim 1, wherein:

in the nozzle lines that overlap in a specific range in the nozzle line direction, the amount of ink ejected from one of the nozzle lines decreases in the overlapping range from one side to the other side in the nozzle line direction, and the amount of ink ejected from the other nozzle line decreases to the one side in the nozzle line direction.

7. The fluid ejection device described in claim 1, wherein:

black ink is ejected from a nozzle of one nozzle line for ejecting black ink, and ink is ejected from a corresponding nozzle of another nozzle line, to form a black dot.

8. A fluid ejection device that ejects ink from nozzles forming a nozzle line extending in a nozzle line direction perpendicular to a conveyance direction while conveying a recording medium by a paper feed roller in the conveyance direction, forming dots on the recording medium, wherein:

different nozzle lines that eject ink of the same color are separated in the conveyance direction while overlapping in a specific range in the nozzle line direction, the separation distance of the nozzle lines being a distance corresponding to the conveyance distance of the recording medium when the paper feed roller rotates an integer number of revolutions.

9. The fluid ejection device described in claim 8, wherein:

the separation distance is a distance corresponding to an integer multiple of the outside circumference of the paper feed roller.

10. The fluid ejection device described in claim 8, wherein:

in the nozzle lines that overlap in a specific range in the nozzle line direction, the amount of ink ejected from one of the nozzle lines decreases in the overlapping range from one side to the other side in the nozzle line direction, and the amount of ink ejected from the other nozzle line decreases to the one side in the nozzle line direction.

11. A method of manufacturing a fluid ejection device that ejects ink from nozzles forming a nozzle line extending in a nozzle line direction perpendicular to a conveyance direction while conveying a recording medium by a paper feed roller in the conveyance direction, forming dots on the recording medium, the manufacturing method producing:

a first recording head unit having nozzle lines disposed with a gap therebetween in the conveyance direction, and a second recording head unit that has nozzle lines configured in the same way as the nozzle lines of the first recording head unit and is disposed separated from the first recording head unit in the conveyance direction, so that the first recording head unit and second recording head unit overlap in a specific range in the nozzle line direction, and the separation distance between a first nozzle line in the first recording head unit and a second nozzle line disposed to the second recording head unit at a position corresponding to the first nozzle line is a distance corresponding to the distance offset the conveyance distance of the recording medium in a half revolution of the paper feed roller from the conveyance distance of the recording medium in an integer number of revolutions of the paper feed roller.

12. The method of manufacturing a fluid ejection device described in claim 11, wherein:

the separation distance is a distance corresponding to the outside circumference of the paper feed roller multiplied by (n−½) (where n is a positive integer).

13. The method of manufacturing a fluid ejection device described in claim 11, wherein:

the first nozzle line and the second nozzle line are both nozzle lines for ejecting black ink.

14. The method of manufacturing a fluid ejection device described in claim 11, wherein:

the first nozzle line is a nozzle line for ejecting black ink, and the second nozzle line is a nozzle line for ejecting ink of a color with high optical density.

15. The method of manufacturing a fluid ejection device described in claim 11, wherein:

the first nozzle line and second nozzle line are nozzle lines for ejecting ink of colors of similar chroma.

* * * * *